United States Patent [19]

Eckert

[11] 4,084,845

[45] Apr. 18, 1978

[54] SECURITY LOCK FOR EMERGENCY DOOR LATCH MECHANISM

[76] Inventor: Robert L. Eckert, 11231 Foster Rd., Los Alamitos, Calif. 90720

[21] Appl. No.: 695,792

[22] Filed: Jun. 14, 1976

[51] Int. Cl.[2] ..... E05C 15/02

[52] U.S. Cl. ..... 292/92; 70/92; 292/DIG. 2

[58] Field of Search ..... 292/92, DIG. 2, 346; 70/DIG. 58, 92, 418

[56] References Cited

U.S. PATENT DOCUMENTS

| | | | |
|---|---|---|---|
| 2,198,359 | 4/1940 | Voight et al. | 70/92 |
| 2,212,957 | 8/1940 | Spradling | 292/92 |
| 3,130,994 | 4/1964 | Balducci | 292/92 X |
| 3,148,903 | 9/1964 | Foster | 292/92 X |
| 3,530,695 | 9/1970 | Balducci | 70/92 |
| 3,705,739 | 12/1972 | Adler | 292/92 |
| 3,788,688 | 1/1974 | Chandler | 292/92 |

*Primary Examiner*—J. Franklin Foss

*Attorney, Agent, or Firm*—Fulwider, Patton, Rieber, Lee & Utecht

[57] ABSTRACT

There is disclosed a security lock for emergency door latches which are typically provided with a crash bar pivotally carried on the door and extending transversely across its inner face. The security lock comprises a bracket arm which is pivotally mounted on the side brackets of the door latch mechanism and which carries, on its free end, a cover bar which overlies a substantial portion of the crash bar. The bracket arm is provided with locking means for restraining its pivotal movement whereby the bracket arm and its dependent cover bar can be restrained in a raised or lowered position, thereby preventing actuation of the crash bar, or locking the crash bar in its latch disengaging position.

9 Claims, 12 Drawing Figures

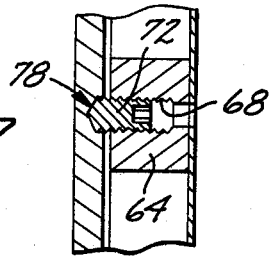
FIG. 7
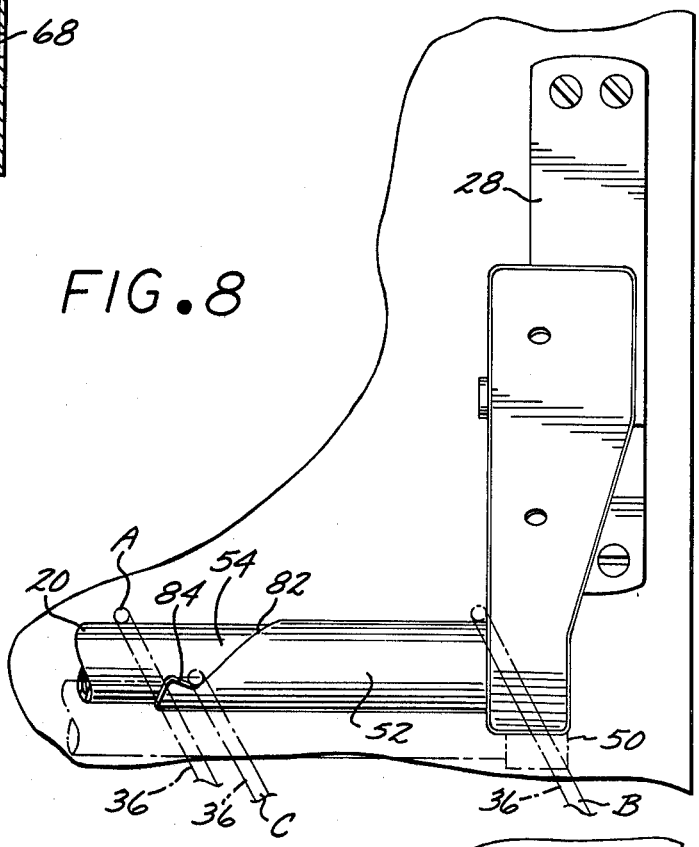
FIG. 8
FIG. 11
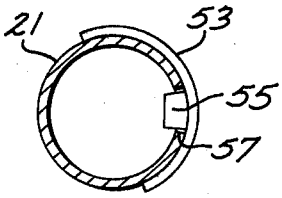
FIG. 12
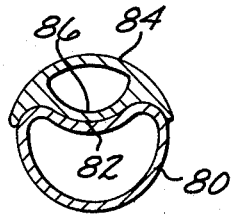
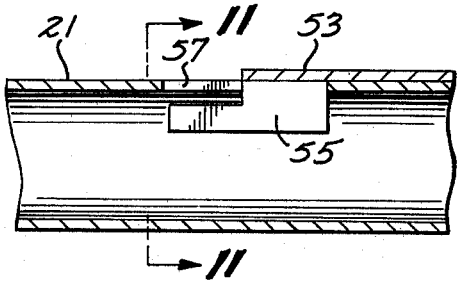
FIG. 10
FIG. 9
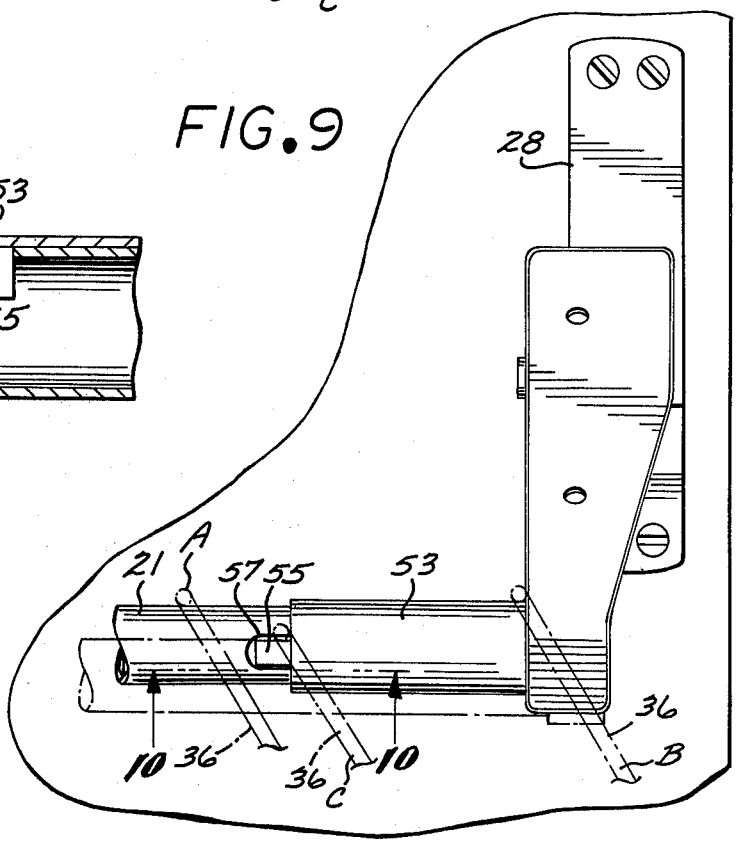

SECURITY LOCK FOR EMERGENCY DOOR LATCH MECHANISM

BACKGROUND OF THE INVENTION

1 Field of the invention

This invention relates to a security device, and, in particular to a security device for emergency door latches equipped with a depressable crash bar. 2. Brief statement of the prior art Emergency and exit doors of public doors of public buildings and the like are required to have latch mechanisms that can be safely operated by occupants of the building. Typically these doors have a latch mechanism bearing a crash bar that is pivotally mounted by distal pivot arms to extend transversely across the inner face of the door. This latch mechanism presents substantial security problems since the crash bar can be actuated from the exterior of the door by inserting a wire hook through the crack between the doors of a pair of double swinging doors or the crack between the door and the door jam of single doors. An effective and automatic locking mechanism has not been designed for these doors, particularly because of the safety requirement that such lock mechanisms not defeat or interfere with the free opening of the door by actuation of the crash bar. One lock mechanism, disclosed in U.S. Pat. No. 212,957, employs an arm carried on the inner face of the door and bearing a clasp that can be fastened about the crash bar. One difficulty with this device is that it cannot be used under most municipal safety codes whenever the building is occupied because it restrains the crash bar against free movement. Another locking mechanism, disclosed in U.S. Pat. No. 3,877,262, is useful with a crash bar that is mounted for translation rather than pivotal movement.

BRIEF STATEMENT OF THE INVENTION

This invention comprises a security device for emergency and exit door latches that have a pivotally mounted crash bar actuator carried on the inner face of the door. The security device comprises a bracket arm that is pivotally mounted on the crash bar supporting brackets which are carried at the opposite edges of the door and a cover bar which, preferably, has an open face having the same contour as the crash bar and which receives a distal portion of the crash bar. The device includes locking means for restraining the bracket arm against pivotal movement whereby the crash bar is provided with a fixed-position cover bar that will intercept and restrain a wire hook and the like, such as has been previously employed to gain forced entry through doors having this type of latch mechanism.

BRIEF DESCRIPTION OF THE DRAWINGS

The preferred embodiments of the invention will be described with reference to the figures of which:

FIG. 7 is a view similar to that of FIG. 5 showing the block means of the invention in position;

FIG. 8 illustrates the operation of the security device of the invention;

FIGS. 9–11 illustrate an alternative embodiment of the security device, and

FIG. 12 is a sectional view of another embodiment.

DESCRIPTION OF PREFERRED EMBODIMENTS

Figure 1:
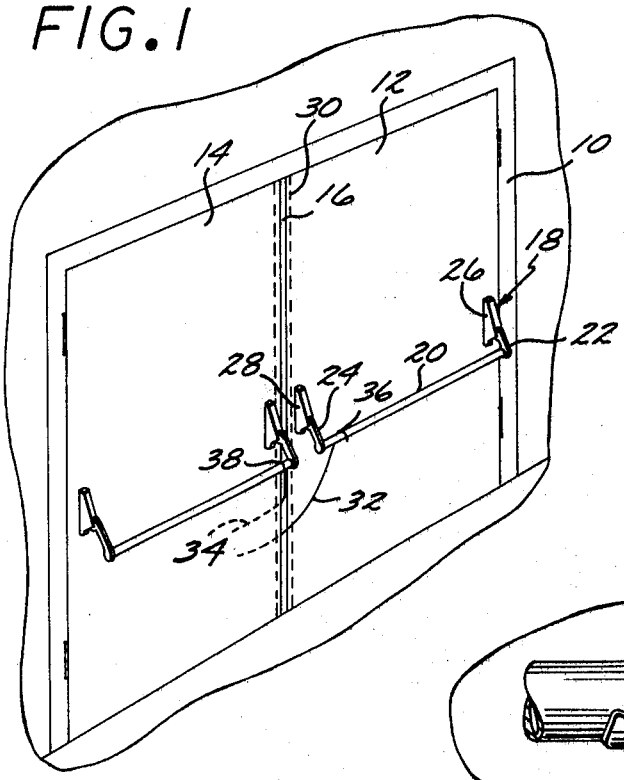
FIG. 1 illustrates the manner of forced entry through doors secured by the crash bar type of latch mechanism.
Figure 2:
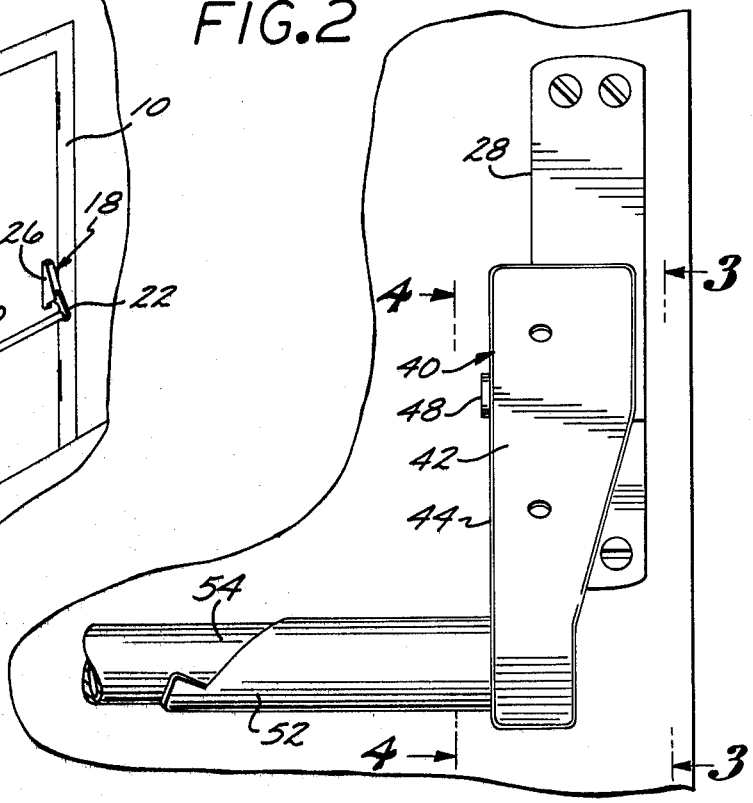
FIG. 2 is a front view of the invention as applied to the aforementioned latch mechanism.

The invention is a security lock for door latches and the like such as shown in FIG. 1. As there illustrated, a door frame 10 surrounds a pair of hinged doors 12 and 14 which have a crack 16 between their inside edges. The doors are provided with latches 18 that include a crash bar 20 that extends transversely across the inner face of each door. The crash bar is mounted, distally, by a pair of parallel bar arms 22 and 24 that are pivotally carried by pin means to side brackets 26 and 28 that are secured to each side of the inner face of each door.

The bar arms 22 and 24 are mechanically linked to actuate the bolt of the latch mechanism to advace or retract the bolt from its engagement with a keeper. Commonly, the bolt of the latch extends vertically along the inside edge of the door, as shown by broken line 30 to engage a keeper at the top of the door frame and/or in sill of the doorway.

One of the hazards of the aforedescribed latch mechanism is that there is no effective provision for preventing unauthorized actuation of the latch mechanism from the exterior side of the door while, still permitting frree actuation of the latch mechanism by crash bar 20. FIG. 1 illustrates the manner in which forced entry to the building can be accomplished. As shown in FIG. 1, a stiff wire hook and the like, 32 and 34, can be inserted into crack 16 between the adjacent doors and directed upwardly until its hook, 36 and 38, engage the crash bar. At this position, the intruder need only retract the wire 32 or 24. As the wire is retracted, its hook travels along the crash bar 20 until it engages the bar arm 24. Continued retraction of the wire depresses the crash bar and actuates the latch mechanism, permitting entry through the door.

This invention is intended to prevent the aforedescribed intrusion through doors bearing the crash bar latch mechanism. In this application, the invention is illustrated in FIGS. 2–8 and includes a bracket arm 40 which can be a sheet metal stamping having a lateral flange 42 with a dependent web 44. The web 44 bears means such as aperture 46 (see FIG. 4) to permit its pivotal mounting to the side bracket 28. In the preferred embodiment, the aperture 46 receives the distal portion of the pin 48 which pivotally secures the bar arm 50 (see FIG. 3) to the side bracket 28.

The free end of bracket arm 40 bears cover bar means 52 which extends therefrom to overlie a distal portion 54 of the crash bar 20. The cover bar can overlie a length from 1 to about 12 inches of the end of the crash bar. Preferably, the cover bar means is of the same contour as the crash bar 20 and has an open face 56 (see FIG. 4) to receive distal portion 54 of the crash bar.

The bracket arm 40 can have a channel shape with a side web 58 and receives the bar arm 50 of the latch mechanism within its channel, between webs 34 and 58. The free end of bracket arm 44 bears a notch 60 to permit reception of the distal portion 54 of the crash bar 20.

The bracket arm 40 also bears locking means for restraining it against pivotal movement. The locking means is generally indicated at 62 and is shown in sectional detail in FIGS. 5 and 7. This locking means includes a block 64 carried on the inner face 66 of web 44 of the generally channel-shaped bracket arm 40. Block 64 is bored and internally threaded at 68 and has a smaller diameter counter-bore at 70. A set screw 72 is received within the threaded bore 68. Access to the wrench flats 74 of the set screw 72 is through counterbore 70.

Figure 5:
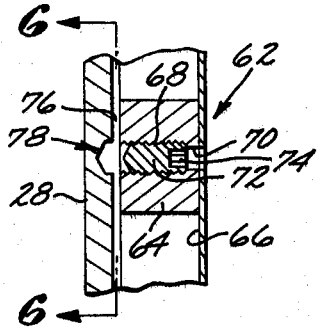
FIG. 5 is a view along lines 5—5 of FIG. 4.

The face 76 of side bracket 28 bears denting means 78 which can comprise a surface recession, as shown in FIG. 5, that is coaxial with threaded bore 68 to receive the end of set screw 72 when the latter is advanced from its threaded reception in block 64.

Figure 6:
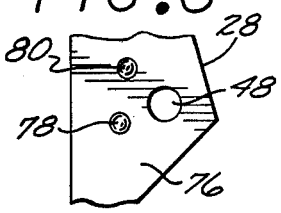
FIG. 6 is a view along line 6—6 of FIG. 5.
Figure 3:
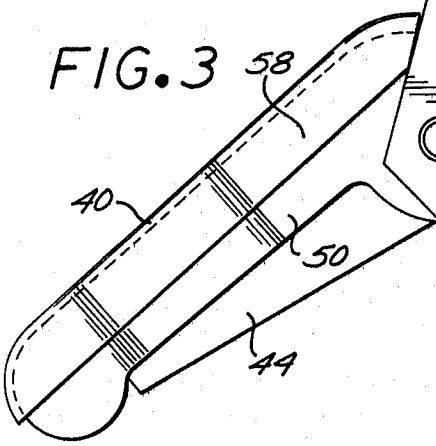
FIG. 3 is a view along lines 3—3 of FIG. 2.
Figure 3:
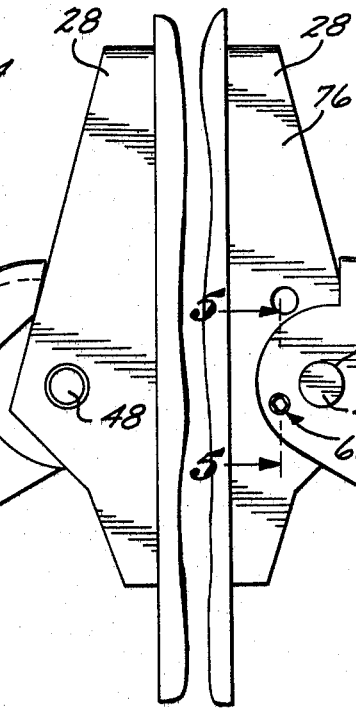
Figure 4:
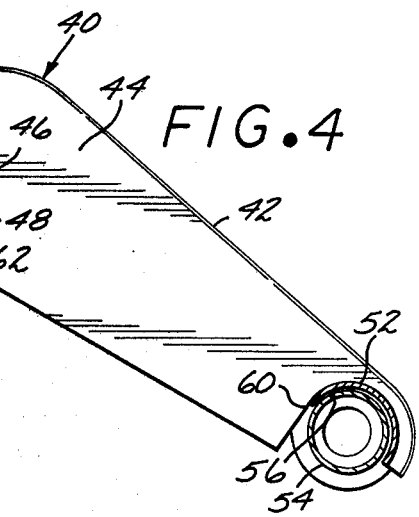
FIG. 4 is a view taken along line 4—4 of FIG. 2.

In the preferred embodiment detent means are provided whereby the bracket arm 40 can be locked in raised and depressed positions. FIG. 6 illustrates such detenting recessions 78 and 80 which are provided on face 76 of side bracket 28 on a common radial spacing from pivot pin 48 carried by the side bracket.

Referring now to FIG. 7, the set screw 72 is shown in its advanced position from its reception in threaded bore 68 of block 64 such that the end of the set screw is received within the detenting recess 78, thereby locking bracket arm 40 against pivotal movement on side bracket 28.

The cover bar 52 that overlies the distal portion 54 of the crash bar 20 intercepts the hook arm 36 of a wire such as wire 32 described with regard to FIG. 1. The attempted actuation of the latch mechanism with the wire beings with the wire in the position A shown in FIG. 8. The retraction of the wire through the crack 16 will cause the wire to ride over cover bar 52 and move to the position shown at B. The cover bar 52 is rigidly secured to side bracket 28 by set screw 72 and continued pulling on wire 36 will not depress crash bar 20. Occassionally, latch mechanisms will have weak springs and the wire may not ride over the end of cover bar 52. The wire can depress crash bar 20 and associated bar arm 50 slightly to the position shown by the broken lines of the FIG. 8. Further depressing of crash bar 20 can not be effected since cover bar 52 intercepts the wire 36 when the wire reaches the position shown at C. At this point, the wire will be effectively secured by the cover bar 52.

To enhance the retention of the wire 36 and the like by the security device of the invention, the cover bar 52 can bear a bevelled, free end 82 to allow the wire to slide over the cover bar 52 and a distal notch 84, which serves to retain the wire 36 in the illustrated manner.

FIGS. 9–11 illustrate an alternative embodiment of the invention which employs a slightly modified cover bar 53. As there illustrated, the cover bar 53 distally bears a key 55 that is received within a longitudinal slot 57 of the crash bar 21. The key 55 projects beneath the outer surface of the crash bar 21 and insures that a wire 36 and the like cannot be slipped between the protective cover bar 53 and the crash bar 21. The attempted actuation of the latch mechanism commences with wire 36 in the A position. Retraction of the wire normally moves the wire to the position B. In instances where a latch mechanism has a weak spring, the crash bar may move to the position C and the wire 36 is received by the key 55 which projects from the under surface of the cover bar 53. Any further retraction of wire 36 fails to depress the crash bar 21 and entry to the building cannot be accomplished.

The crash bar, 20 or 21, remains fully effective since substantially the entirety of its length is exposed for actuation by an occupant within the building. The security device of the invention can also be employed to lock the crash bar 20 and 21 in a depressed position, thereby permitting freedom of movement in opposite directions through the doors. This is accomplished by moving the security device to its depressed position and seating the set screw 78 in the recess 80, shown in FIG. 6. While most crash bar latches have locks to secure the crash bar depressed, this invention can provide an alternative lock when used to retrofit existing latches. It can also eliminate the need for a separate depressed bar lock when provided as original equipment with the latch mechanism. Thus, by a simple adjustment, the security device can be employed for locking of the latch mechanism in a depressed position or freely permitting its spring biased movement into its latch engaging position.

An alternative construction is shown in FIG. 12. There, the crash bar 80 has a groove 82 which can be rolled or pressed into one end of the bar during its manufacture. The cover bar 84 is provided with a cylindrical surface 86 of approximately the same diameter as bar 80 and with a coextensive reinforcement rib 88 on its undersurface that seats in groove 82. Rib 88 can have a contour matching that of groove 82. The cover 84 can be of solid form or can be as shown with hollow form construction.

The invention has been described with reference to the presently illustrated and preferred embodiments thereof. It is not intended that the invention be unduly limited by the illustrated and preferred embodiments. Instead, it is intended that the invention be defined by the means, and their obvious equivalents, set forth in the following claims.

What is claimed is:

1. A security lock for door latches and the like having a crash bar extending transversely across the inner face of a door and mounted at its opposite ends by each of a pair of parallel bar arms that are pivotally carried by pin means on side bracket means secured to said door and that are mechanically linked to move the bolt of said latch between closed and open positions which comprises:

a bracket arm with means for its pivotal mounting to said side bracket means;

cover bar means mounted on the free end of said bracket arm and extending therefrom to overlie a distal portion of said crash bar; and locking means mounted on said bracket arm for fixedly restraining said bracket arm in a raised position against pivotal movement while permitting said crash bar to move between latch closed and latch open positions.

2. The security lock of claim 1 wherein said bracket arm bears an aperture to receive the pin of said pin means carrying one of said bar arms.

3. The security lock of claim 1 wherein said locking means comprises a set screw carried on said bracket arm and extendable to engage a detenting recess on said side bracket means.

4. The security lock of claim 1 wherein said locking means is also engageable to restrain said bracket arm in a depressed position, preventing said crash bar from moving to a latch closed position.

5. The security lock of claim 1 wherein said cover bar means has an open face with a contour conforming to and receiving a distal portion of said crash bar.

6. The security lock of claim 1 wherein said cover bar means extends a distance of from 1 to about 12 inches along the distal portion of said crash bar.

7. The security lock of claim 1 wherein said cover bar means bears a distal notch along the inner quadrant of said crash bar.

8. The security device of claim 1 wherein said cover bar distally carries a key on its undersurface and said crash bar has a longitudinal slot to receive said key in its up position.

9. The security device of claim 8 wherein said key projects distally of said cover bar and is recessed to at least the surface of said crash bar.

* * * * *